United States Patent [19]

Bauer

[11] 4,012,890

[45] Mar. 22, 1977

[54] MACHINE FOR ENVELOPING ARTICLES WITH PLASTICS FILM

[76] Inventor: Everhard Bauer, Hudeweg 2, 4700 Paderborn, Germany

[22] Filed: Oct. 20, 1975

[21] Appl. No.: 624,013

[30] Foreign Application Priority Data

Oct. 23, 1974 Germany ..... 2450373

[52] U.S. Cl. ..... 53/198 R; 53/228

[51] Int. Cl.[2] ..... B65B 11/16

[58] Field of Search ..... 53/228, 229, 198 R, 53/230, 231, 232

[56] References Cited

UNITED STATES PATENTS

| | | | |
|---|---|---|---|
| 3,224,161 | 12/1965 | Conti | 53/228 |
| 3,307,326 | 3/1967 | Krebs | 53/228 X |
| 3,504,476 | 4/1970 | Ehrenfried | 53/229 X |
| 3,596,435 | 8/1971 | Graves | 53/228 X |

*Primary Examiner*—Travis S. McGehee
*Assistant Examiner*—J. Sipos
*Attorney, Agent, or Firm*—Howard C. Miskin

[57] ABSTRACT

In a machine for enveloping an article with plastics film, the leading end of the film is held fast and a pusher moves the article in a path between the leading end of the film and a supply roll therefor so that a loop of film becomes partially slung about the article, whereupon a movable beam completes the loop prior to welding the loop ends together. A knife on a pivotable lever severs the loop and co-operates with a clamping lever to hold fast the new leading end of film for enveloping a successive article.

6 Claims, 5 Drawing Figures

MACHINE FOR ENVELOPING ARTICLES WITH PLASTICS FILM

The invention relates to a machine for enveloping articles with plastics film, comprising a push arm for horizontally displacing the articles against a web of film which is withdrawn from a supply roll and supplied by way of at least one direction-changing roll disposed above the displacement path of the articles, the leading end of the web being held during insertion by tongs which are disposed under the displacement path and controlled in sequence with the operating cycle of the machine, and comprising a vertically guided pulling and welding beam which, after displacement of the articles, is lowerable for the purpose of bringing together and welding the ends of the loop of film pulled about the articles and for severing same with a percussion knife mounted on a pivotable lever and for supplying the new end of film to the holding tongs.

The object of the present invention is therefore to provide a simplified machine for enveloping articles with a greater efficiency.

This object is achieved in a machine of the aforementioned kind in that the tongs are formed by a clamping lever co-operating with one side of the knife, wherein the knife as well as the clamping lever are movable from the position at which the web of film is severed and engaged to the insertion and enveloping position. By combining the percussion knife and clamping lever to form holding tongs in accordance with the invention, the construction can be simplified because the percussion knife undertakes a dual function, whereby one arm of the tongs and its associated control are dispensed with. The machine according to the invention therefore has a higher efficiency, is simplified and can be manufactured more economically.

Preferably, the pulling beam is provided at its lower end on the side opposite to the welding bar with a recess into which the knife strikes and which is laterally bounded by a comb bar through which cams of the bar-form clamping lever can engage. Whereas in the known machine the free end of the web of film is pushed through in the downward direction and fed to the holding tongs by a comb that is lowerable from the pulling beam, in the machine according to the invention the clamping lever engages through the comb bar fixed to the pulling beam and presses the free end of the web of film that has been severed by the percussion knife against the side of the knife and holds same for the next enveloping step.

The clamping lever may be mounted on a shaft connected to the knife carrier.

In a further development of the invention, the pulling and welding beam and the pusher are secured at a horizontal spacing from each other to a carriage which is movable on a raisable and lowerable guide.

An example of the invention will now be described in more detail with reference to the drawing.

In the drawing

FIG. 4 is a view corresponding to FIG. 3 after the severing knife has struck in.

Figure 1:
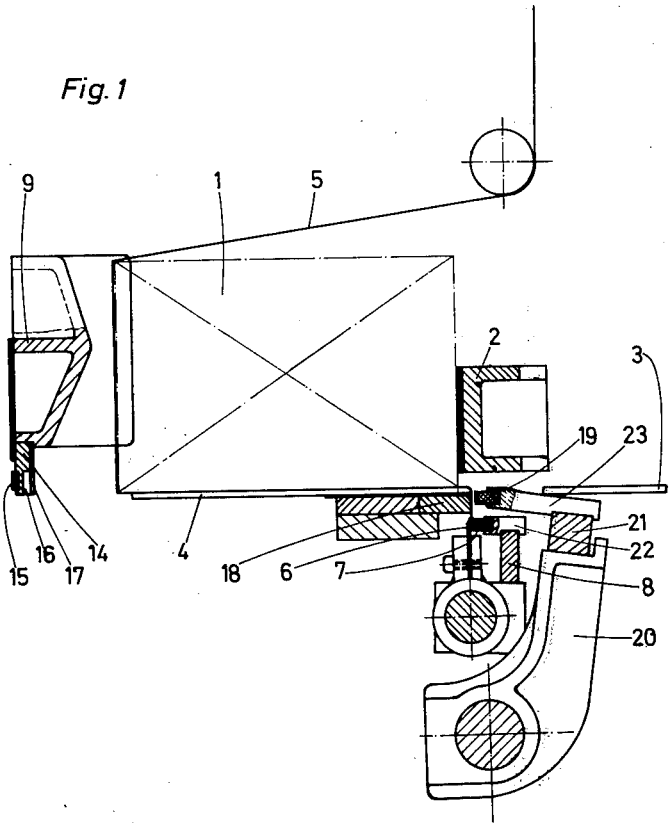
FIG. 1 is a partially vertical diagrammatic longitudinal section through the machine after completed insertion of the article to be packaged.

The machine comprises a horizontal displacement plane for the articles 1 to be enveloped, the plane being formed by the table plates 3, 4 which are fixed with respect to the frame. The articles 1 are advanced by the pusher 2 against the taut web 5 of film, of which the free end is clamped and held between a side face of the percussion knife 6 and the clamping cams 7.

The pusher 2 and the welding and pulling beam 9 are secured at a spacing from each other on a carriage 10 which is reciprocatable on a guide 11 over the displacement path of the articles to be enveloped. The guide 11 is mounted for vertical displacement on the columns 12, 13. The displacement of the carriage 10 in the horizontal direction as well as the lowering and raising of the guide 11 on the columns 12, 13 is effected by control elements which are not shown in more detail.

The horizontal spacing between the pusher 2 and the welding and pulling beam 9 is at least as large as the longest length of the articles to be enveloped.

Between the table plates 3 and 4 there is formed a gap into which the front portion of the lowered pulling and welding beam 9 can move. This front portion consists of a bar 14 which, at its front side, carries a welding bar 15 of silicon rubber or other heat-resistant material. The back of the bar 14 is provided with a recess 16 which is closed by a rear comb bar 17 to form a downwardly open groove. In the lowered position of the pulling and welding beam 9, the severing knife 6 strikes into this groove to sever the ends of the loop of film slung about the article 1.

Under the front end of the table edge 4 there is a welding bar 18 which co-operates with the welding bar 15 of the pulling and welding beam 9. The compression between the welding bars 15 and 18 necessary for welding the ends of film is exerted through the pressure cams 19 from the pivoted lever 20 onto the bar 17 of the pulling and welding beam 9. The pressure cams 19 are secured in fingers 23 which are connected to the pivoted lever 20 by way of a carrier 21. The table plate 3 is interrupted by gaps at least at its front region so that the fingers 23 can work in the vicinity of the table plate.

Figure 3:
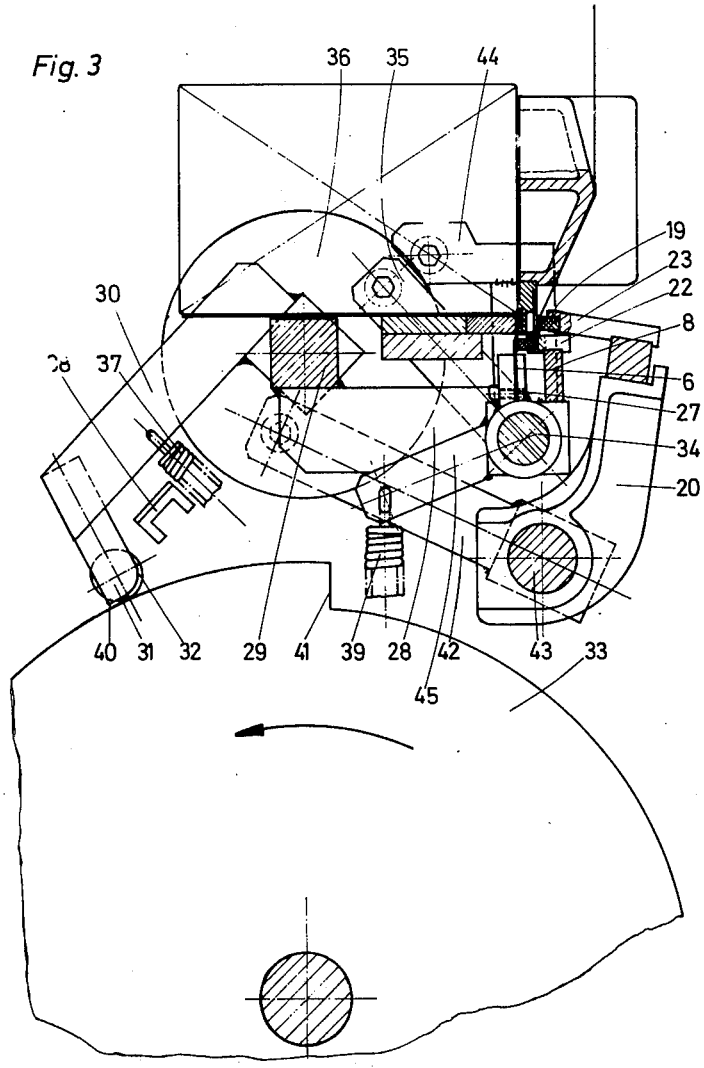
FIG. 3 is a view of the machine corresponding to FIG. 1 with lowered pulling beam and diagrammatic representation of the control.

The basic construction of the control of the percussion knife 6, clamping lever 8 as well as lever 20 is evident from FIG. 3. The percussion knife 6 is secured to the lever 28 by way of the knife holder 27, the lever 28 being in turn secured to the shaft 29 which is mounted in the machine frame. Welded to the shaft 29 there is the control lever 30 of which the free end is provided with a carrier member 31 for the running roller 32. The carrier member 31 comprises a sliding-off edge 40. The roller 32 runs on the driven cam plate 33 which has a shoulder 41. The sliding-off edge 40 glides over the shoulder 41 so that the percussion knife 6 drops into the groove 16 of the welding and pulling beam 9 under the action of the spring 37 and severs the web 5 of film or the ends of the loop of film laid about the article 1.

The control of the clamping lever 8 which is pivotable on shaft 34 is effected by the lever 44 which is connected thereto and the end of which carries a slide member or a running roller which rides on the outer cam track of the cam plate 36. The cam member 36 exhibits an eccentricity which corresponds to the opening and closing movement of the clamping lever 8.

At its rear side, the cam plate 36 carries a further cam (not shown) in which a slide member or a guide roller of the lever 42 rides for controlling the lever 20 which is pivotable about the shaft 43.

The displacement of the percussion knife 6 from its position for severing the film to its position for holding the film for the enveloping step is effected by way of the cam lever 35 which carries a slide member or a running roller at its end and operates in a cam track (not shown) at the front of the cam member. The cam lever 35 is fixed to the knife holder 27 and this, in turn, is mounted on the shaft 34 on which clamping lever 8 is also mounted. The shaft 34 is fixed to the percussion lever 28.

Figure 2:
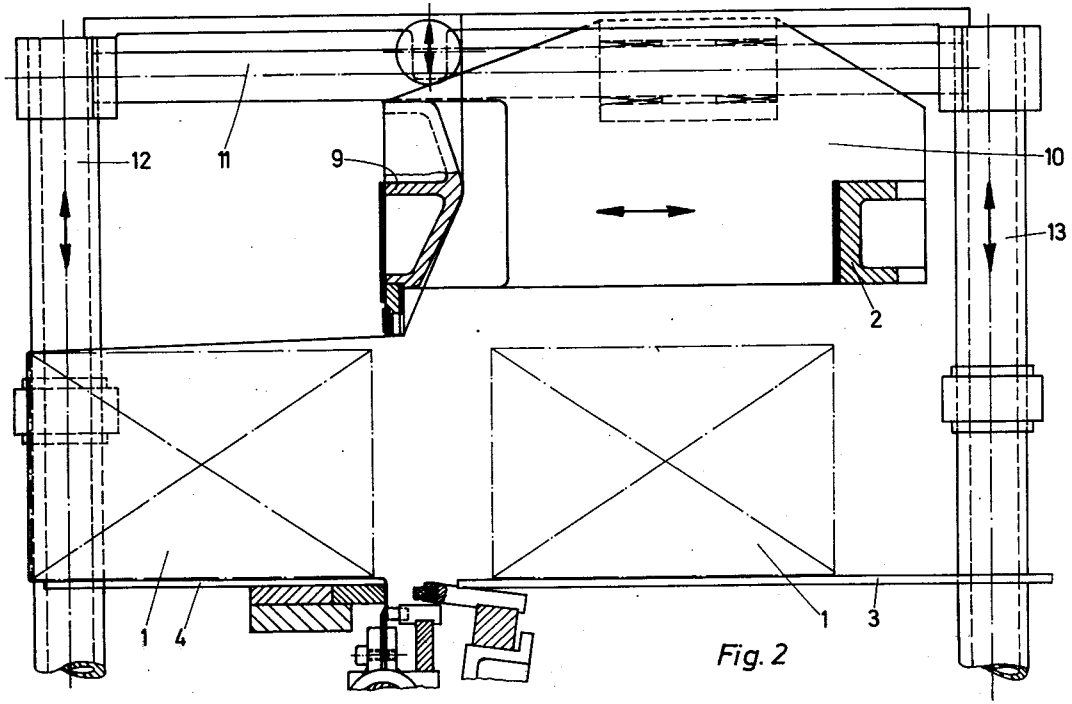
FIG. 2 is a view of the machine corresponding to FIG. 1 prior to lowering of the pulling beam.

The manner of operation of the machine is as follows: The leading end of the web 5 of film is held between one side of the severing knife 6 and the clamping cams 7 on fingers 22 of the clamping lever 8 so that an upright portion of film 5 extends from the supply roll (not shown) through the displacement path defined by table plates 3,4. With the carriage 10, and hence the beam 9 and pusher 2, lowered, the article 1 to be enveloped is advanced in a manner not shown to be inserted between the pusher 2 and the welding and pulling beam 9 up to a stop (not shown), the article 1 being disposed on the pusher side of the upright film section. By means of displacement of the carriage 10, the pusher 2 then pushes the article 1 along plates 3,4 to the position shown in FIG. 1 thereby, the article 1 withdrawing from the supply roll the length of film required to form the loop and measuring itself. By means of initially vertical and then horizontal displacement of the carriage 10, the welding and pulling beam 9 moves to its raised position shown in FIG. 2 and is then lowered vertically into the gap formed between the plates 3 and 4, the loop enveloping the article 1 being completed by the beam 9 further pulling on the web 5 of film. Meanwhile, the leading end of film is still being clamped, as will be evident from FIGS. 2 and 3.

The pressure cams 19 in fingers 23 thereupon press in the manner evident from FIG. 3 against the back of the bar 14 under the action of levers 42 and 20 and press the welding bars 15 and 18 onto one another, a current impulse for the momentary heating of the welding bar 18 being switched on for the purpose of welding the ends of the loop of film.

Figure 4:
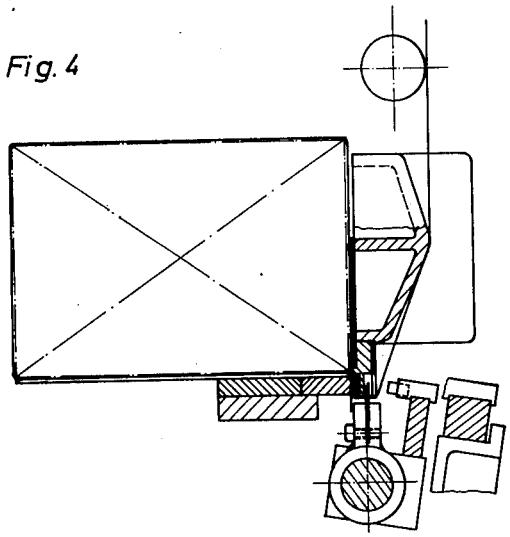
Figure 5:
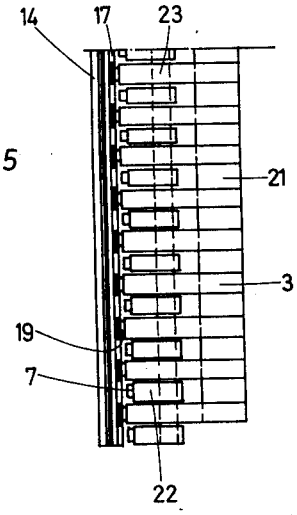
FIG. 5 is a fragmentary plan view of the displacement plane with the cams of the lever pressing on the pulling and welding beam passing therethrough.

Thereafter the clamping cams 7 of the pivoted lever 8 lift off from the side of the knife 6 by the lever 8 pivoting on shaft 34 under the action of cam lever 44 and the severing knife 6 is steered by cam lever 35 (which is fixed to knife holder 27) out of its film retaining position into position opposite the aforementioned recess 16, subsequently striking upwardly into the recess 16 of the bar 14 under the action of lever 28 in order to sever the loop of film. The clamping cams 7 of the clamping lever 8 move upwardly together with the severing knife 6 (because lever 28 carries the shaft 34 on which lever 8 is pivoted) and the cams 7 move into the gaps between the pressure fingers 23. This condition of the machine is shown in FIG. 4. Subsequently, the cams 7 slide through the gaps of the comb bar 17 and press the new leading end of film against the side of the knife 6. The forceful pressing is exerted by way of the tension spring 39 which is secured to the end of the lever 45. The lever 45 is fixed to the clamping lever 8.

The control cam for the clamping lever 8 is so formed that the running roller of the lever 44 can lift off. The pressure cams 19 are now relaxed by way of the lever 20 and the pulling beam 9 moves vertically out of the welding gap to an extent such that, with some spacing from the table plate 4, it can push off the enveloped article 1 by means of its subsequent horizontal motion.

Simultaneously, the next article to be enveloped is pushed into the tautly held film by the pusher 2. The severing knife 6 and the clamping lever 8 with the clamping cams 7, which hold the leading end of film 5, move in unison and simultaneously with the first vertical stroke of the pulling beam 9 into the holding position beneath the front face of the welding bar 18. By moving the pressure fingers 23 forwardly up to just in front of the table plate 4, the welding gap is subsequently closed so that the next article to be enveloped can pass the welding gap (see the position of the pressure cams 19 in FIG. 1).

Shortly before insertion of the pulling beam, the gap is opened again.

I claim:

1. A machine for enveloping successive articles with plastics film unwound from a supply roll therefor, comprising means defining a horizontal displacement path for each article, means for holding fast the leading end of said film at a holding station beneath said displacement path whereby an upright portion of said film extends through said displacement path, a pusher member for moving said article up to and beyond said upright film portion while said leading end is being held, whereby a loop of said film becomes partially slung about said article while additional film is pulled from said supply roll, a beam movable downwardly towards said holding means at said holding station to complete said loop in a lowered position by engaging the film with its end and bringing an intermediate film portion into juxtaposition with said leading film end while pulling a still further length of said film from said supply roll, a stationary welding bar disposed beneath said displacement path and above said holding means at said holding station, a backing bar carried by said movable beam at one side for cooperating with said welding bar to join the ends of said loop, a percussion knife for severing said loop from said intermediate film portion at a severing station, said holding means being formed by said percussion knife and by a pivotable clamping lever operable to engage one side of said knife with said leading film end clamped therebetween, means for disengaging said clamping lever from said knife, means for moving said knife from said holding station to a position opposite said severing station, means for impelling said knife and said disengaged clamping lever to said severing station whereby said loop is severed, means for re-engaging said clamping lever with said knife side at said severing station to hold a new leading end of film, and means for returning said knife and reengaged clamping lever to said holding station.

2. The machine as defined in claim 1, wherein said movable beam comprises a recess which is formed adjacent its said film-engaging end and is bounded at a side opposite to said backing bar-carrying side by a comb bar, wherein said percussion knife is received in said recess at said severing station, and wherein said clamping lever includes film clamping cams engageable through said comb bar at said severing station.

3. The machine as defined in claim 1, wherein said percussion knife is carried by a knife holder and wherein said knife holder and said clamping lever are pivotably mounted on a common shaft that forms part of said impelling means.

4. The machine as defined in claim 1, wherein said movable beam and said pusher are secured at a horizontal spacing from each other to a horizontally and vertically displaceable carriage.

5. The machine as defined in claim 1, including a driven cam plate, three cam tracks on said cam plate, and a cam follower engaged with each of said cam tracks, wherein a first said cam follower forms part of said means for moving said knife from said holding station to said position opposite said severing station, a second said cam follower forms part of said means for disengaging said clamping lever from said knife, and a third said cam follower forms part of means for pressing said backing bar onto said welding bar.

6. The machine as defined in claim 2 including a plurality of spaced pressure fingers for urging said backing bar against said welding bar, wherein said film clamping cams are engageable between said pressure fingers at said severing station.

* * * * *